US007987789B2

(12) United States Patent
Regebro et al.

(10) Patent No.: US 7,987,789 B2
(45) Date of Patent: Aug. 2, 2011

(54) METHOD FOR REDUCING THE AMOUNT OF AMMUNITION TYPES TO BE USED AND AN AMMUNITION DEVICE

(75) Inventors: Christer Regebro, Eskilstuna (SE); Jyrki Helander, Eskilstuna (SE)

(73) Assignee: SAAB AB, Linköping (SE)

( * ) Notice: Subject to any disclaimer, the term of this patent is extended or adjusted under 35 U.S.C. 154(b) by 365 days.

(21) Appl. No.: 11/715,389

(22) Filed: Mar. 8, 2007

(65) Prior Publication Data

US 2008/0141891 A1 Jun. 19, 2008

(51) Int. Cl.
*F42B 10/00* (2006.01)

(52) U.S. Cl. ..... 102/476; 102/306; 102/308; 102/478; 102/265; 102/270

(58) Field of Classification Search ..... 102/306, 102/308, 476, 478, 265, 270
See application file for complete search history.

(56) References Cited

U.S. PATENT DOCUMENTS

| | | | | |
|---|---|---|---|---|
| 3,750,582 | A | 8/1973 | Kintish et al. | |
| 4,063,512 | A * | 12/1977 | Davis | 102/476 |
| 4,102,271 | A * | 7/1978 | Bethmann | 102/521 |
| 4,145,972 | A * | 3/1979 | Menz et al. | 102/270 |
| 4,612,859 | A * | 9/1986 | Furch et al. | 102/476 |
| 4,714,022 | A * | 12/1987 | Chaumeau et al. | 102/476 |
| 5,180,882 | A * | 1/1993 | Bansard | 102/216 |
| 5,415,105 | A * | 5/1995 | Voss et al. | 102/476 |
| 5,509,357 | A | 4/1996 | Lawther | |
| 5,902,954 | A * | 5/1999 | Hetz | 102/307 |
| 5,970,876 | A | 10/1999 | Haglund | |
| 6,026,750 | A * | 2/2000 | Nelson | 102/476 |
| 6,393,991 | B1 * | 5/2002 | Funston et al. | 102/476 |
| 6,453,817 | B1 * | 9/2002 | Markel et al. | 102/306 |
| 6,467,416 | B1 | 10/2002 | Daniels et al. | |
| 6,899,032 | B2 * | 5/2005 | Ronn et al. | 102/307 |
| 6,925,924 | B2 * | 8/2005 | Baker et al. | 89/1.151 |
| 7,493,861 | B1 * | 2/2009 | Walters | 102/476 |
| 7,658,150 | B2 * | 2/2010 | Ronn et al. | 102/476 |
| 2004/0211335 | A1 | 10/2004 | Helander | |

FOREIGN PATENT DOCUMENTS

| | | | |
|---|---|---|---|
| DE | 2829001 | A1 | 9/1980 |
| DE | 19917144 | A1 | 12/1999 |
| DE | 19638295 | B3 | 4/2004 |
| GB | 2337576 | A | 11/1999 |
| WO | WO-02/03010 | A | 1/2002 |

OTHER PUBLICATIONS

DE19638295 translation Aug. 4, 2004.*
European Search Report.

* cited by examiner

*Primary Examiner* — Bret Hayes
*Assistant Examiner* — Michael D David
(74) *Attorney, Agent, or Firm* — Venable LLP; Eric J. Franklin

(57) ABSTRACT

A method for reducing the amount of ammunition types to be used against a wide set of targets. At least two explosive charges are made use of in cooperation. Each of the explosive charges has changeable characteristics and is arranged to mutually cooperate in different ways depending on the particular changeable characteristics given to the explosive charges in a specific case and the type of target to be combated. An ammunition device admitting a reduction of the amount of ammunition types to be used. At least two cooperating explosive charges are arranged in a row along the direction of movement of the ammunition device when activated. Each of the explosive charges is switchable between at least two operating conditions having different operating characteristics.

13 Claims, 4 Drawing Sheets

METHOD FOR REDUCING THE AMOUNT OF AMMUNITION TYPES TO BE USED AND AN AMMUNITION DEVICE

RELATED APPLICATIONS

The present invention claims priority to European patent application 06445008.3 filed 9 Mar. 2006.

FIELD OF THE INVENTION

The present invention relates to a method for reducing the amount of ammunition types to be used against a wide set of targets, the method making use of at least two explosive charges in cooperation. The invention also refers to an ammunition device admitting a reduction of the amount of ammunition types to be used, namely an ammunition device, such as a shell, projectile or missile, comprising an adaptable warhead comprising at least two cooperating explosive charges arranged in a row along the direction of movement of the ammunition device when activated.

BACKGROUND OF THE INVENTION

In future warfare, combat will be carried out in a great and increased number of different areas. A probable scenario for all operative war cases, such as international efforts, invasion defense and terrorist combating, is that the combat will take place in urban areas. For this reason the number of target types that must be considered and defeated is increasing. In addition to known target types such as armored and unarmored vehicles, troops in open area and field fortifications or bunkers, other types of targets such as troops in buildings, troops or soldiers behind corners and walls and not to forget buildings per se must be considered.

In the past this was solved by bringing special ammunition for each type of target. However, in view of the increased number of target types now present or expected in the future it is not possible to bring all types. First of all this holds for carried weapon systems but also vehicles have limited space and carrying capacity. Furthermore, if a great number of ammunition types are carried there is a risk that the number of ammunition of each type is to small to solve its mission.

Combat in urban areas also often requires that at least some of the ammunition types carried, if not all, are constructed so that they can be used in confined space. A so called CS capability is desirable. Many heavy weapons now used generate too high a pressure wave to be used in confined space. For this reason the number of ammunition types to be carried or transported may be doubled.

Attempts to reduce the number of ammunition types used are previously known. According to U.S. Pat. No. 6,467,416 B1 and U.S. Pat. No. 5,509,357 A some kind of dual or combined operation of a warhead comprising one single explosive charge is known. U.S. Pat. No. 6,467,416 B1 describes a combined high-blast/anti-armour warhead. After impact with the target, the target sensor will trigger a fuse either immediately or after a short delay, depending on weather the warhead is set to anti-armour or high-blast mode. According to U.S. Pat. No. 5,509,357 A the warhead is provided with a front and a rear detonator. Actuation of the rear detonator alone results in an armour piercing mode of operation whereas near simultaneous actuation of both detonators results in a wider area of impact of the forward focused energy and in an enhanced sidespray fragmentation. These known single explosive charge warheads are limited in their effect and are to be regarded as a compromise in obtaining two different ammunition types that are not as effective as desired.

SUMMARY OF THE INVENTION

An object of the invention is to obtain a method and an ammunition device that admit the creation of a more effective warhead for all ammunition type effects to be created by the warhead. Another object is to obtain a warhead that can effect more than two different ammunition types.

The objects are obtained by a method in which each of the explosive charges are given changeable characteristics and are arranged to mutually cooperate in different ways depending on the particular changeable characteristics given to the explosive charges in a specific case and the type of target to be combated. The objects are also obtained by an ammunition device in which each of the comprised explosive charges are switchable between at least two operating conditions having different operating characteristics. By introducing at least two cooperating explosive charges in the warhead and providing each of the explosive charges with a possibility to switch between at least two different operating conditions, it is ensured that a great number of different effective ammunition types can be obtained. According to our solution an ammunition device with an adaptable warhead is obtained in which the operation against the target to be engaged is optimized by changing the operating conditions of the explosive charges included and taking advantage of the cooperation between the explosive charges according to target type. The proposed ammunition device comprises at least two explosive charges that each one can be given changeable characteristics and cooperates in different ways. Accordingly, one single ammunition device is able to have effect on many types of targets and having optimal effect against each of the target types.

According to a first preferred method of the invention a change of characteristics in at least one explosive charge is carried out by choosing different points of initiation.

According to a second preferred method of the invention a change of characteristics in at least one explosive charge is carried out by choosing different stand-off.

According to a third preferred method of the invention a change of characteristics in at least one explosive charge is carried out by choosing different delay times.

According to a forth preferred method of the invention a change of characteristics in at least one explosive charge is carried out by turning off the explosive charge.

According to a fifth preferred method of the invention a change of characteristics in comprised explosive charge is carried out by choosing a mixture of any of the changes proposed according to the first, second, third or forth preferred methods above.

The use of any of the above proposed preferred methods in consideration of the cooperation between comprised explosive charges has turned out to create effective ammunition devices for different types of targets.

In agreement with the above proposed preferred methods there are corresponding preferred ammunition devices in which at least one of the comprised explosive charges comprises at least two different points of initiation corresponding to two different operating conditions, at least one of the comprised explosive charges is provided with a stand off unit switchable between at least two different stand off conditions corresponding to two different operating conditions and/or at least one of the comprised explosive charges is provided with a time delay unit switchable between at least two different time delays corresponding to two different operating conditions.

According to a favourable embodiment of the ammunition device at least one of the comprised explosive charges in one operating condition is designed with a direction of action essentially perpendicular to its direction of movement and restricted to a sector. In this particular operating condition the effect of the explosive charge can be concentrated towards a target perpendicular to the direction of movement of the ammunition device when the ammunition device passes by. Preferably, the ammunition device is arranged to rotate and the sector restricted explosive charge is arranged to be activated under consideration of the rotational position of the explosive charge. Combining the knowledge of the rotation or roll position of the ammunition device with the initiation of a sector restricted explosive charge enables a very accurate effort towards a target while simultaneously the surroundings can be left unharmed. This is very valuable for example when hostile troops and own troops are combating close to each other in urban areas.

According to another favourable embodiment of the ammunition device the device comprises three explosive charges in a row along the direction of movement of the device when activated, the first one being a pre-charge, the second one a main charge and the third one a sector restricted charge in one of its operating conditions. Introducing three explosive charges in which each one of the charges is switchable between at least two operating conditions results in the generation of many different working modes of the ammunition device. For example, if it is assumed that all three comprised explosive charges are switchable between two operating conditions the over all working modes of the ammunition device is $2^3=8$.

Furthermore it is proposed according to still another embodiment that at least one of the comprised explosive charges is a projectile forming shaped charge. According to another embodiment it is proposed that at least one of the comprised explosive charges is a jet forming shaped charge. It is also proposed that at least one of the explosive charges is provided with a fragmentation envelope and furthermore that at least one of the explosive charges is provided with metal rods around the periphery of the charge. Furthermore it is proposed that at least one of the explosive charges is provided with a crush sensor immediately activating a detonation of the explosive charge if sensing a crash. These proposed embodiments considered all together make it clear that a great number of different combinations of effects of the ammunition device can be obtained within the scope of the invention.

BRIEF DESCRIPTION OF THE DRAWINGS

The invention will now be described in more detail with reference to the accompanying drawings in which.

DETAILED DESCRIPTION OF EMBODIMENTS OF THE INVENTION

Figure 1:
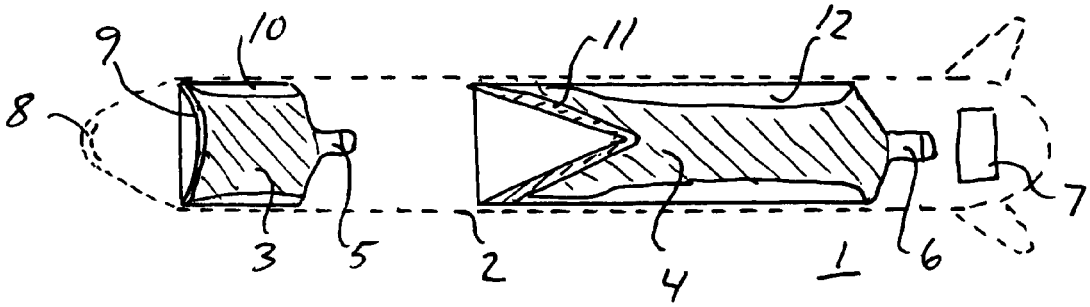
FIG. 1 schematically shows partly in section an example of an ammunition device according to the invention comprising two explosive charges.

The ammunition device 1 schematically shown in FIG. 1 comprises an envelope 2 housing two explosive charges 3 and 4. The ignition of the explosive charges 3, 4 is controlled by safety and arming devices 5 and 6. There is also indicated a processor unit 7 to control the safety and arming devices 5, 6 in dependence of information feed to the processor about the type of target to combat or operating characteristics of the explosive charges to perform. It is also possible to program the arming devices 5, 6 separately and in this case the processor unit 7 can be omitted. The ammunition device may also be provided with some kind of proximity fuse, contact sensor and/or crush sensor. A contact sensor 8 has been indicated as included in the front of the envelope of the ammunition device. This front end located at a distance in front of the front explosive charge 3 can operate as a distance means. A crush sensor, not specifically shown, can preferably be attached to the rear or second charge 4 to detect deformation of the charge before the charge is completely destroyed and initiate an immediate detonation if sensing a crush. Crush sensors per se are known and can for example comprise double shells as proposed in our U.S. Pat. No. 5,970,876 and preferably covering most of the charge.

In the ammunition device shown, the front explosive charge 3 is provided with a liner 9 to create a shaped charge. Furthermore the front charge 3 is provided with a fragmentation envelope 10. The rear explosive charge 4 is also provided with a liner 11 to create a shaped charge adding to the penetration of the front charge or pre-charge 3. Furthermore the envelope of the rear charge is provided with metal rods 12 of concave or other shape.

The front charge is constructed to be switchable to generation of full calibre holes in walls, to creation of encroachment holes in thick armour, to clearance of reactive armour or generation of a first fragmentation field. The switchability is obtained by suitable choice of points of initiation and stand off for the front charge.

Requirements of the rear charge 4 could be that the charge should pass through a hole in a wall and detonate behind the wall, blast an entrance hole in the wall for a soldier, demolish a field fortification, penetrate main armour or continue in a hole that a front charge has started to create. Detonating the rear charge in the air shall result in that a secondary fragmentation field is generated separated from the fragmentation field generated by the front charge. The switching of the rear charge is carried out by changing points of initiating and time delays.

It is to be noted that in the case that the ammunition device is to be carried by a soldier some of the operating facilities may be deleted to reduce the weight of the ammunition device. For such carried ammunition devices a combination that is possible to carry and presenting optimal effect against desired types of targets is chosen.

Figure 2:
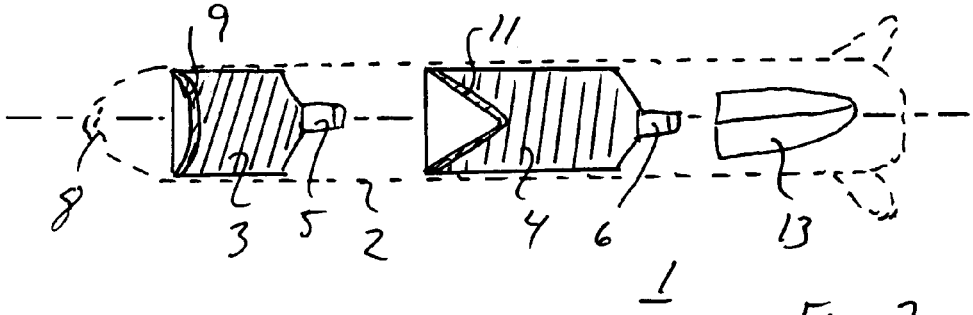
FIG. 2 schematically shows partly in section an example of an ammunition device according to the invention comprising three explosive charges.

The ammunition device 1 showed in FIG. 2 houses an additional explosive charge 13. This charge is non-symmetrical and it is particular useful when it is desired to create directed fragmentation effect. This is i.a. due to the fact that the initiation of the charge 13 is coupled to the rotation position of the ammunition device. For example the charge can be directed towards a hostile troop within an urban area while at the same time our own troops are present nearby without being adversely influenced. In another operating condition of the charge 13 it is also possible to detonate the charge so that the charge is effective all around the charge. The fragmentation effect can also be turned away from objects that must not be damaged.

Figure 3A:
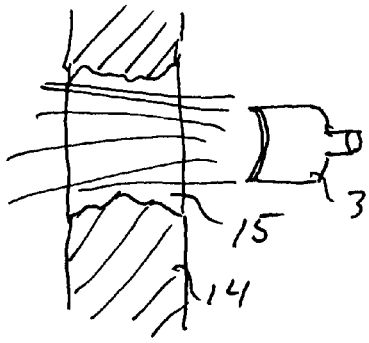
FIGS. 3*a* and 3*b* illustrate the effect of a first use of an ammunition device according to the invention in a first exemplified mode.
Figure 3B:
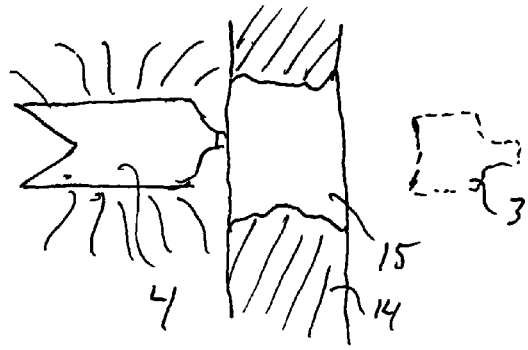

In FIGS. 3*a* and 3*b* it is shown how effect behind a wall is obtained by an ammunition device taking advantage of our invention. In this case the ammunition device comprises two charges, namely a front charge 3 and a rear charge 4. As seen in FIG. 3*a* the front charge 3 being a shaped charge makes a hole 15 in a wall 14. This hole admits the rear charge to pass so that it can be detonated behind the wall, see FIG. 3*b*. A time delay or a sensor controlling the detonation of the rear charge ensures that the detonation takes place after that the charge has passed the wall.

Figure 4A:
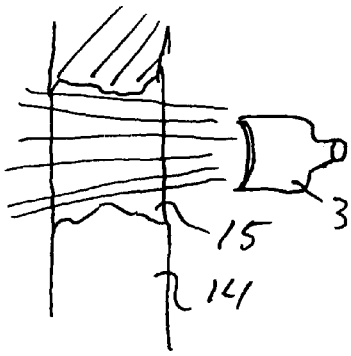
FIGS. 4*a* and 4*b* illustrate the effect of a second use of an ammunition device according to the invention in a second exemplified mode.
Figure 4B:
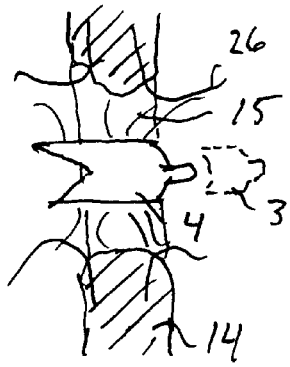

According to FIGS. 4*a* and 4*b* the ammunition device has been switched to another operating condition than that disclosed in FIG. 3*a* and 3*b*. The front charge is again set in an operating condition to make a hole in the wall, see FIG. 4*a*. This operating condition can be identical with the operating condition of the front charge 3 according to FIG. 3*a*. The rear charge 4, however, is set to another operating condition ensuring that the rear charge detonates within a shorter time delay when it is likely that the rear charge is situated within the hole 15 of the wall 14 so that the hole 15 in the wall 14 can be enlarge admitting a soldier to pass. In this case it is of great value to direct most of the rear charge effect in a radial direction outwards perpendicular to the direction of movement of the rear charge. This can be obtained by a suitable choice of a point of ignition and taking advantage of the metal rods 12 comprised in the rear charge according to the embodiment discussed with reference to FIG. 1. From FIG. 4*b* it is clear that a large hole has been created and that reinforcement bars 26 in the wall 14 have been bent away.

Figure 5A:
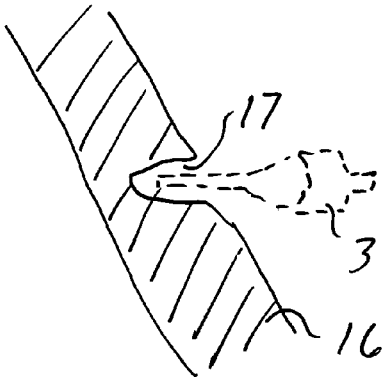
FIGS. 5*a* and 5*b* illustrate the effect of a third use of an ammunition device according to the invention in a third exemplified mode.
Figure 5A:
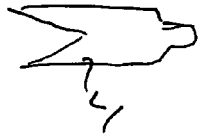
Figure 5B:
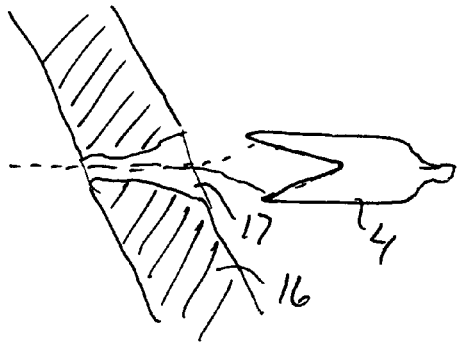

According to FIGS. 5*a* and 5*b* the ammunition device is used to attack thick amour 16. In this case the front charge is set to an operating condition igniting in a point of ignition of a front shaped charge 3 that generates a narrow jet or projectile like object to penetrate the armour 16 and makes a wide hole 17. The rear charge is also set to a condition to create a jet or projectile like object that continues the penetration of the armour in the same hole 17 and makes a deep hole 15 (added penetration). There is also set a time delay between the ignition of the front and back charge sufficient for the front charge to create the wide entry hole before the rear charge penetrates the armour. An activated shaped charge normally comprises a slug. It is however known to eliminate the slug and it is proposed to use such a slugless shaped charge as a front charge.

Figure 6:
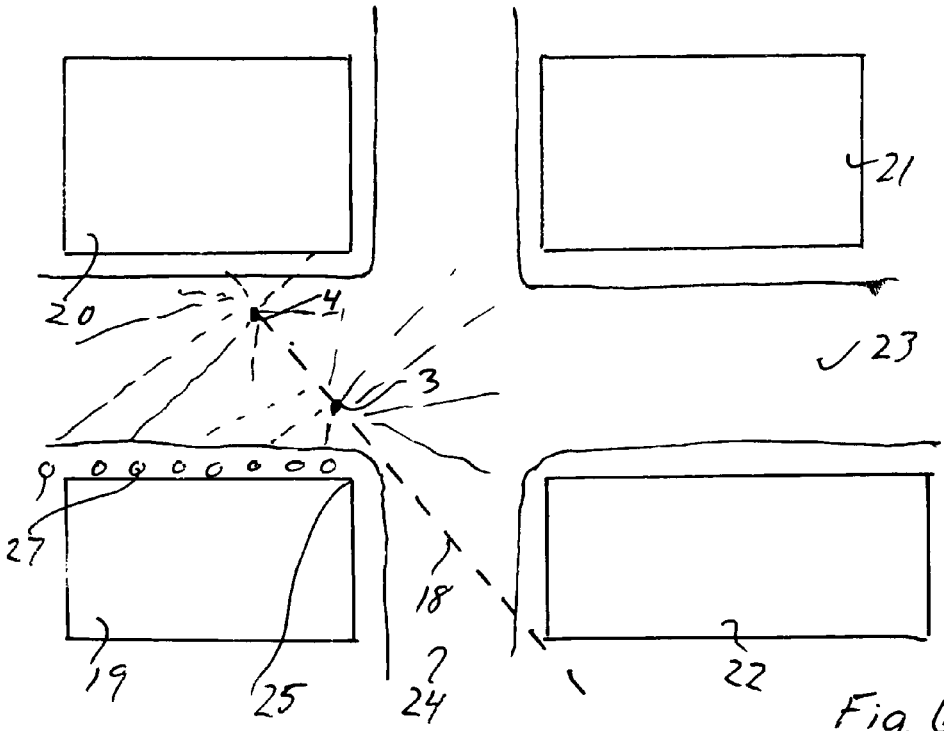
FIG. 6 illustrates the effect of a forth use of an ammunition device according to the invention in a forth exemplified mode.

In FIG. 6 an operating condition of an ammunition device provided with two explosive charges can be used to create a double field of fragments in the air. A dashed line 18 indicates the route of the ammunition device in an urban area seen from above exemplified with four buildings 19, 20, 21 and 22 and two crossing streets 23, 24. In this case the two charges 3, 4 are set to an operating condition in which fragments are generated. Furthermore, there is a time delay between the ignition of the front charge and the rear charge. In the particular operating conditions set for the charges of the ammunition device, the front charge 3 is detonated in the crossing between the streets close to the corner 25 of the building 19. Then the rear charge 4 will detonate a little bit later close to the building 20. Detonation under these operating conditions will cause a fragmentation field that covers a considerable area and an enemy troop 27 close to the building 19 will be defeated.

Figure 7:
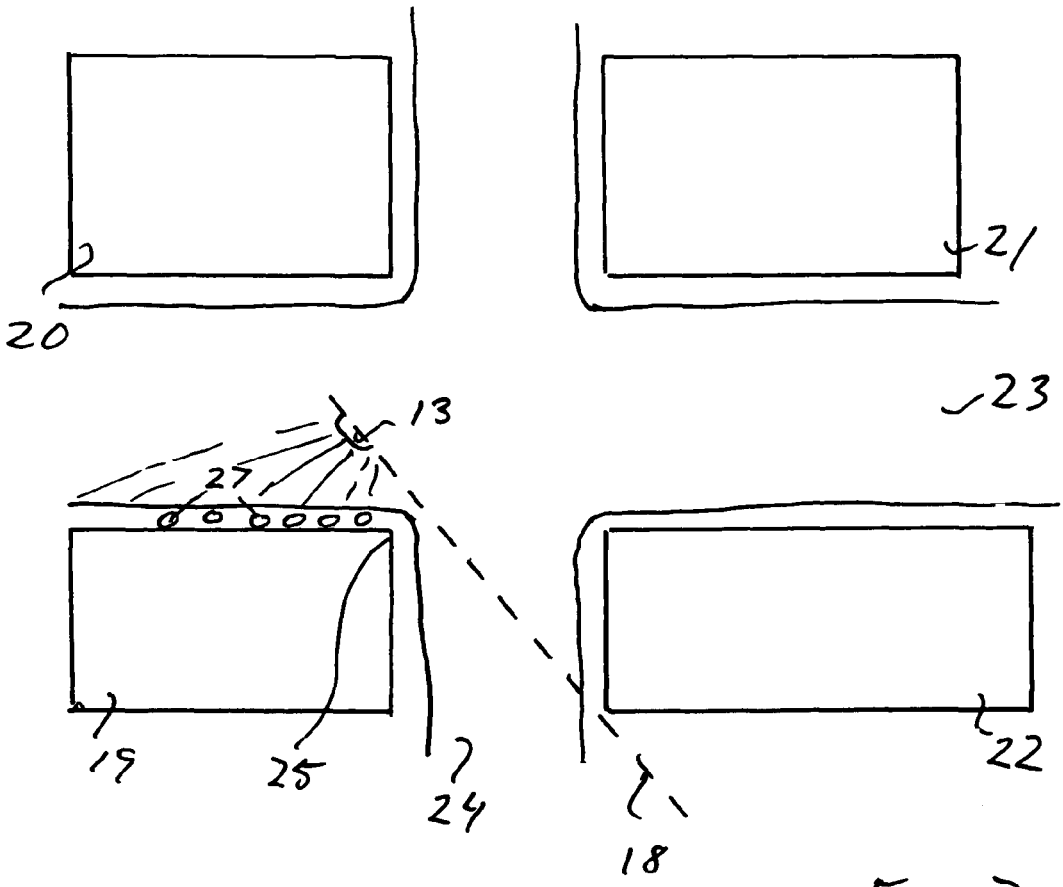
FIG. 7 illustrates the effect of a fifth use of an ammunition device according to the invention in a fifth exemplified mode.

In FIG. 7 an alternative scenario to FIG. 6 is considered. In this case there are requirement for a more restricted mission attacking a delimited area. For this scenario an ammunition device of the kind described with reference to FIG. 2 is used. Buildings and streets are located as described in FIG. 6. A dashed line 18 again indicates the route of the ammunition device. In this case the ammunition device is set to such operating conditions that the third charge 13 is the one to be activated in a direction restrictive mode in order to obtain the desired effect. The conditions for detonation are here set such that the third charge 13 is detonated when the charge passes close to the corner 25 of the building 19 and is in such a rotational position that the effect of the charge will be directed towards the building 19. Such a use of the ammunition device enables a very limited mission attacking for example an enemy troop 27 but preserving most of the buildings, inhabitants and own troops.

Finally it is discussed below how three explosive charges of an ammunition device can be used in different operating modes depending on the type of target to be combated. In the following the charges are denoted first charge 3, second charge 4 and third charge 13. The first charge 3 can also under certain circumstances be called a precursor, while the second charge can be called a main charge. The third charge is a non-symmetrical charge which can create an explosive blast or directed fragmentation.

When used against a main battle tank, MBT, or an infantry fighting vehicle, IFV, the first charge is set to clear reactive armour and to create initial penetration. The second charge continues the penetration while the third charge can be set to a turned of condition if needed for low collateral effect.

When used against an thin armoured personal carrier, APC, the first charge is set to create a full calibre entry hole while the second and third charges are set to burst close to and/or behind armour plates.

When used against an unarmoured vehicle the first charge is set to burst behind the surface of the unarmoured vehicle or set to be turned off. The second charge is also set to burst behind the same surface or set to be turned of. The third charge can be set to directed blast or set to be turned off.

When used against a fast attack craft, FAC, the first charge is set to create an entry hole while the second charge is set to burst close to and/or behind hull plates. The third charge can be set to generate directed fragmentation or set to be turned off.

When used against a helicopter it is proposed to initiate all three charges simultaneously. The ammunition device can be set to directed fragmentation or direct hit.

When used against soldiers in buildings the first charge is set to create an entry hole in a wall, roof or similar obstacle. The second charge can be set to be turned off and the third charge can be set to be initiated behind the obstacle in a directed fragmentation condition or to be set to be turned off.

When used against soldiers in the open area the third charge can be set to directed fragmentation. All charges can then be set to be initiated simultaneously or alternatively the first and/or the second charges can be set to be turned off.

When used against a field bunker the first charge can be set to create a channel while the second and third charges are initiated simultaneously with a delay.

When used against concrete structure the first charge can be set to create a channel and the second and third charges can be set to be initiated simultaneously by a crush sensor.

The device for indicating the direction according to the invention is not limited to the embodiments described above, but can be modified within the framework of the following claims and concept of the invention.

The invention claimed is:

1. An ammunition device, comprising:

an adaptable warhead comprising at least two cooperating explosive charges arranged in a row along the direction of movement of the ammunition device when activated, wherein each explosive charge comprises a safety and arming device, wherein each explosive charge is switchable between at least two operating conditions having different operating characteristics controlled by programming each of the safety and arming devices to one of the at least two operating conditions in dependence of information about the type of target to combat and operating characteristics of the explosive charge to be performed.

2. The ammunition device according to claim 1, wherein at least one of the explosive charges comprises at least two different points of initiation corresponding to the two different operating conditions.

3. The ammunition device according to claim 1, wherein at least one of the explosive charges comprises a stand off device switchable between at least two different stand off conditions corresponding to the two different operating conditions.

4. The ammunition device according to claim 1, wherein at least one of the explosive charges comprises a time delay device switchable between at least two different time delays corresponding to the two different operating conditions.

5. The ammunition device according to claim 1, wherein at least one of the explosive charges in one operating condition is designed with a direction of action essentially perpendicular to its direction of movement and restricted to a sector.

6. The ammunition device according to claim 5, wherein the ammunition device is arranged to rotate and wherein the sector restricted explosive charge is arranged to be activated under consideration of the rotational position of the explosive charge.

7. The ammunition device according to claim 5, wherein the ammunition device comprises three explosive charges in a row along the direction of movement of the device when activated, the first one being a pre-charge, the second one a main charge and the third one a sector restricted charge in one of its operating conditions.

8. The ammunition device according to claim 1, wherein at least one of the explosive charges comprises a projectile forming shaped charge.

9. The ammunition device according to claim 1, wherein at least one of the explosive charges comprises a jet forming shaped charge.

10. The ammunition device according to claim 1, wherein at least one of the explosive charges comprises a fragmentation envelope.

11. The ammunition device according to claim 1, wherein at least one of the explosive charges comprises metal rods around the periphery of the charge.

12. The ammunition device according to claim 1, wherein at least one of the explosive charges comprises a crush sensor immediately activating a detonation of the explosive charge if sensing a crash.

13. An ammunition device according to claim 1, wherein the ammunition device comprises a shell, projectile or missile.

* * * * *

UNITED STATES PATENT AND TRADEMARK OFFICE

CERTIFICATE OF CORRECTION

PATENT NO. : 7,987,789 B2
APPLICATION NO. : 11/715389
DATED : August 2, 2011
INVENTOR(S) : Christer Regebro et al.

It is certified that error appears in the above-identified patent and that said Letters Patent is hereby corrected as shown below:

On the title page insert item (30),

--EP Patent Application No. 06445008, Filed March 9, 2006--.

Signed and Sealed this
Third Day of January, 2012

David J. Kappos

David J. Kappos
*Director of the United States Patent and Trademark Office*